US011427981B2

(12) United States Patent
Scopetti, Jr.

(10) Patent No.: US 11,427,981 B2
(45) Date of Patent: Aug. 30, 2022

(54) SHORING DEVICE FOR CORNERS

(71) Applicant: Frank A. Scopetti, Jr., Scottsdale, AZ (US)

(72) Inventor: Frank A. Scopetti, Jr., Scottsdale, AZ (US)

( * ) Notice: Subject to any disclaimer, the term of this patent is extended or adjusted under 35 U.S.C. 154(b) by 0 days.

(21) Appl. No.: 17/081,016

(22) Filed: Oct. 27, 2020

(65) Prior Publication Data

US 2021/0180280 A1 Jun. 17, 2021

Related U.S. Application Data

(60) Provisional application No. 62/948,381, filed on Dec. 16, 2019.

(51) Int. Cl.
*E02D 17/04* (2006.01)
*E02D 17/08* (2006.01)

(52) U.S. Cl.
CPC ..... *E02D 17/04* (2013.01); *E02D 17/08* (2013.01)

(58) Field of Classification Search
CPC ..... B66F 5/00; E04G 2025/047
USPC ..... 405/282
See application file for complete search history.

(56) References Cited

U.S. PATENT DOCUMENTS

| | | | | |
|---|---|---|---|---|
| 4,090,365 | A * | 5/1978 | Nieber | C08G 77/60 405/282 |
| 6,848,865 | B2 | 2/2005 | Kadiu | |
| 7,101,119 | B2 | 9/2006 | Cerda | |
| 7,258,511 | B1 * | 8/2007 | Cerda | E02D 17/08 405/272 |
| 8,028,492 | B2 * | 10/2011 | Grypeos | E04B 2/8652 52/837 |
| 2004/0170478 | A1 | 9/2004 | Kadiu | |
| 2004/0223814 | A1 | 11/2004 | Meyer | |
| 2006/0070803 | A1 * | 4/2006 | Han | E02D 17/04 182/87 |
| 2008/0155925 | A1 * | 7/2008 | Pfeiffer | E04B 2/8617 52/426 |
| 2011/0305529 | A1 | 12/2011 | Riggle | |

FOREIGN PATENT DOCUMENTS

| | | | |
|---|---|---|---|
| WO | WO 2007/058464 | * | 5/2007 |
| WO | WO 2010/097642 | * | 9/2010 |

* cited by examiner

*Primary Examiner* — Sean D Andrish
(74) *Attorney, Agent, or Firm* — Boudwin Intellectual Property; Daniel Boudwin

(57) ABSTRACT

A shoring device for corners is shown and described. One of the models for the corner shoring device includes a first sidewall connected to a second sidewall, wherein the first sidewall and the second sidewall form an angled connection. A support wall is connected to each of the first sidewall and the second sidewall within the angle to prevent the sidewalls form closing in on each other.

6 Claims, 5 Drawing Sheets

SHORING DEVICE FOR CORNERS

CROSS REFERENCE TO RELATED APPLICATIONS

This application claims the benefit of U.S. Provisional Application No. 62/948,381 filed on Dec. 16, 2019. The above identified patent application is herein incorporated by reference in its entirety to provide continuity of disclosure.

BACKGROUND OF THE INVENTION

The present invention relates to shoring devices. More particularly, the present invention provides a shoring device for shoring corners.

When working on construction sites that require straight line excavation for utility trenches, footers, etc., it is often required that the trenches have a shoring system in place. The shoring system is required to provide a safe work environment for craftsmen and meet stringent Occupational Safety and Health Association (OSHA) standards. Without the shoring system in place settlement, collapse and shifting are all risks that can be dangerous and deadly to workers.

When shoring a straight trench, workers may use prefabricated metal shoring devices. In some instances, these devices have prefabricated metal shoring devices also known as trench boxes. In some instances, another type of device has preinstalled hydraulic fixers to press the shores up against the trench wall. At other times timber is used to shore the trench walls. Timbers are already straight and will only need to be secured together. Shoring a straight trench can be a simple task for these reasons.

Shoring corners on the other hand is a laborious, costly, and still potentially dangerous task. In some instances, metal is used to create custom corner shores. This, however, is expensive and extremely time consuming, so often times timber is used to create corner shoring. When using timber, the process is still time consuming. Further, the workers must ensure each corner piece is properly constructed and secured together to avoid risk of collapse.

Consequently, there is a need for an improvement in the art of shoring corners in a trench or tunnel. The present invention substantially diverges in design elements from the known art while at the same time solves a problem many people face when having to shore corners. In this regard the present invention substantially fulfills these needs.

SUMMARY OF THE INVENTION

The present invention provides a shoring device for shoring corners and T branches wherein the same can be utilized for providing convenience for the user when having to shore corners and T branches in trenches and tunnels. One embodiment of the shoring device for corners is comprised of a first sidewall connected to a second sidewall, wherein the first sidewall and the second sidewall form an angled connection. A support wall is connected to each of the first sidewall and the second sidewall within the angle to prevent the sidewalls form closing in on each other.

Another object of the shoring device for corners is to provide an angled connection that is a 90-degree connected with the vertex of the angle pointing outward.

Another object of the shoring device for corners is to provide a support wall that has a pair of support braces connected thereto.

Another object of the shoring device for corners is to provide at least one hydraulic arm connected to the pair of support braces.

Another object of the shoring device for corners is to provide a plurality of apertures along the perimeter of the first sidewall and the second sidewall on the edge opposite the connection.

Another object of the shoring device for corners is to provide a shoring device that is made from aluminum.

Another embodiment of the shoring device for corners is comprised of a first sidewall connected to a second sidewall, wherein the first sidewall and the second sidewall form an angled connection. A first support connector is attached to the exterior of the first sidewall and a second support connector is attached to the exterior of the second sidewall. A support wall is connected to the first support connector and the second support connector.

Another object of the shoring device for corners is to provide an angled connection that is a 90-degree connected with the vertex of the angle pointing inward.

Another object of the shoring device for corners is to provide a support wall which has a pair of support braces connected thereto.

Another object of the shoring device for corners is to provide at least two hydraulic arms connected to the pair of support braces.

Another object of the shoring device for corners is to provide a plurality of apertures along the perimeter of the first sidewall and the second sidewall on the edge opposite the connection.

Another object of the shoring device for corners is to provide a shoring device that is made from aluminum.

Yet a further embodiment of the shoring device for corners is comprised of a first sidewall connected to a second sidewall, wherein the first sidewall and the second sidewall form an angled connection. A first pair of support braces are connected to the exterior of the first sidewall. A second pair of support braces are connected to the exterior of the second sidewall.

Another object of the shoring device for corners is to provide an angled connection which is a 90-degree connected with the vertex of the angle pointing outward.

Another object of the shoring device for corners is to provide at least one hydraulic arm connected to the first pair of support braces and the second pair of support braces.

Another object of the shoring device for corners is to provide a plurality of apertures along the perimeter of the first sidewall and the second sidewall on the edge opposite the connection.

Another object of the shoring device for corners is to provide a shoring device is made from aluminum.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

LIST OF REFERENCE NUMERALS

Figure 1:
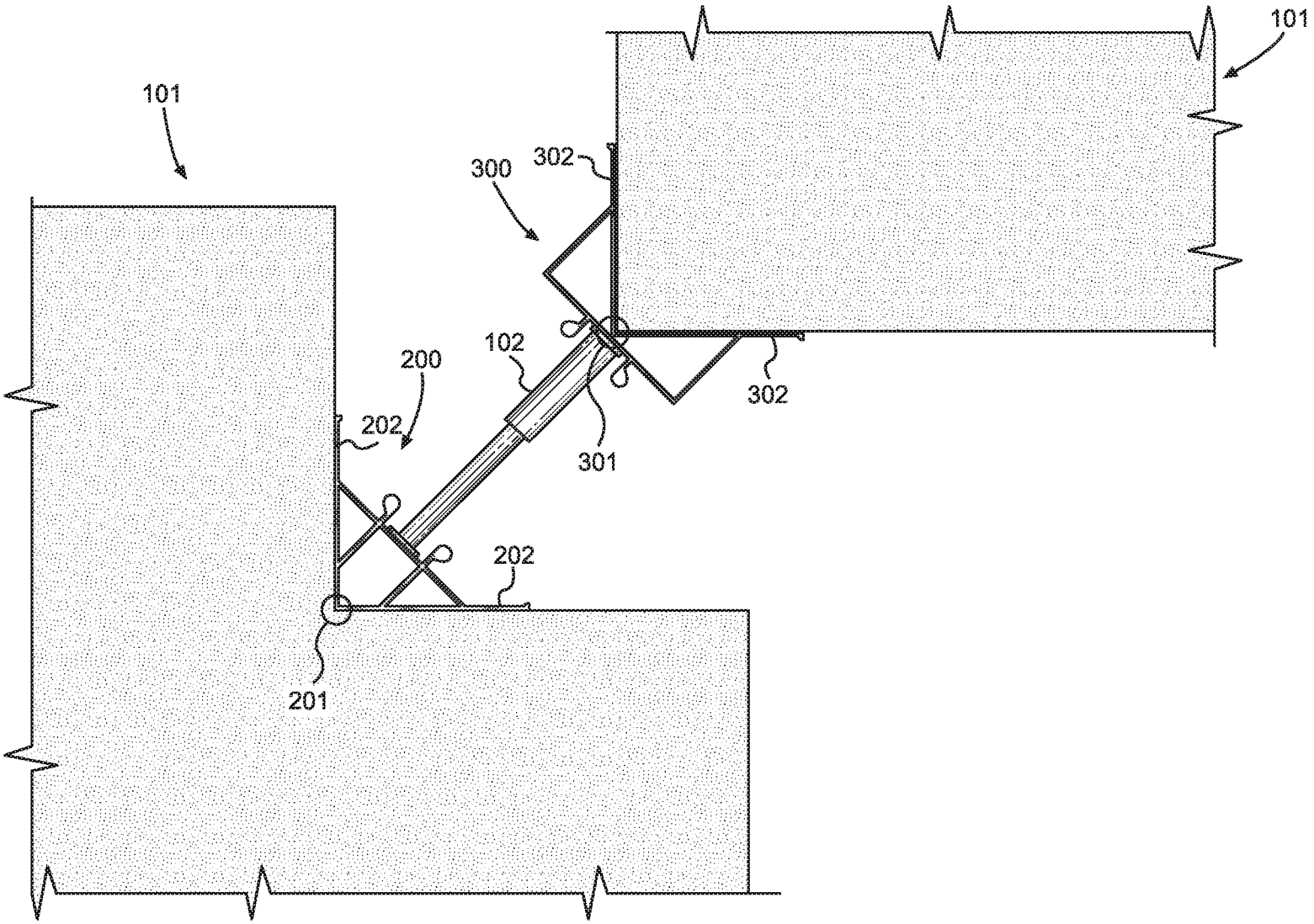
FIG. 1 shows an in-use view of several embodiments of the shoring devices for corners.

With regard to the reference numerals used, the following numbering is used throughout the drawings.

101 Ground wall
102 Hydraulic arm
200 Interior angle corner shoring device
201 Vertex
202 sidewalls
203 Interior angle
204 Apertures
205 Support wall
206 Support braces
207 Apertures
300 Exterior angle corner shoring device
301 Vertex
302 Sidewalls
303 Exterior angle
304 Apertures
305 Support wall
306 Support Connectors
307 Support braces
308 Apertures
400 Corner shoring device for T corners
401 Vertex
402 Sidewalls
403 Interior angle
404 Apertures
405 Support braces
406 Apertures
410 Supporting plate

DETAILED DESCRIPTION OF THE INVENTION

Reference is made herein to the attached drawings. Like reference numerals are used throughout the drawings to depict like or similar elements of the shoring device for corners. For the purposes of presenting a brief and clear description of the present invention, a preferred embodiment will be discussed as used for the shoring device for corners. The figures are intended for representative purposes only and should not be considered to be limiting in any respect.

Referring now to FIG. 1, there is shown an in-use view of several embodiments of the shoring devices for corners. The depicted image shows a potential use for two of the three disclosed corner shoring devices. The first corner shoring device is an interior angle shoring device 200. The interior angle corner shoring device 200 has a vertex 201 that points outward in relation to the device. This vertex 201 points outward into the corner of the corner to be shored. The sidewalls 202 of the interior corner shoring device 200 extend out form the vertex 201 and support the surrounding ground wall 101. For a more complete description of the interior angle corner shoring device 200 see the description of FIG. 2A and FIG. 2B.

The opposite corner shoring device in the shown example is an exterior angle corner shoring device 300. The exterior angle corner shoring device 300 has an inward pointing vertex 301 that points towards the rest of the device. The vertex 301 allows a corner to fit within the created angle. The exterior angle corner shoring device 300 has sidewalls 302 that extend away from the vertex 301 and support the surrounding ground wall 101.

In the shown embodiment each corner shoring device 200, 300 has a hydraulic arm 102 connected thereto. In the shown embodiment, only one hydraulic arm 102 is shown, however multiple hydraulic arms 102 may be connected to each corner shoring device 200, 300. In the shown embodiment, both corner shoring devices 200, 300 use the hydraulic arm 102 to apply pressure to the vertex 201, 301 of the respected devices 200, 300. In some embodiments hydraulic arms 102 are used to apply pressure to the sidewalls of the devices. In these embodiments the hydraulic arm as extending linearly between the two corner shoring devices, such that the hydraulic arm extends through a line defined by the two vertices 201, 301.

Figure 2B:
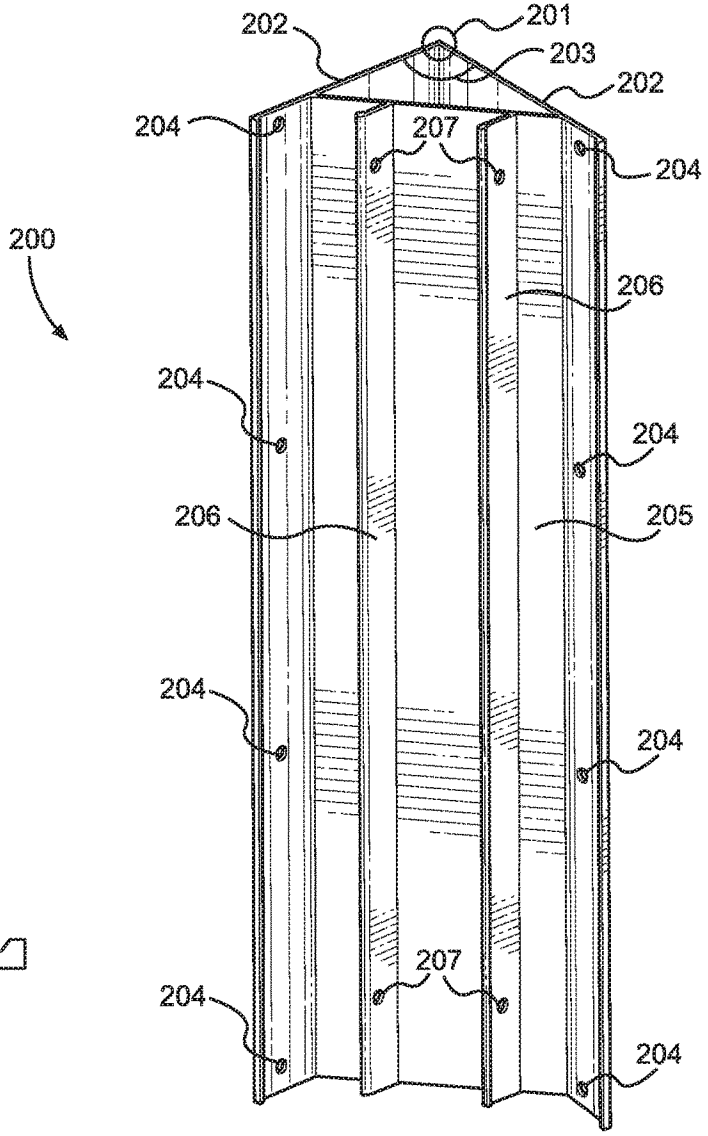
FIG. 2B shows a perspective view of an embodiment of an inside corner device for the shoring device for corners.
Figure 2A:
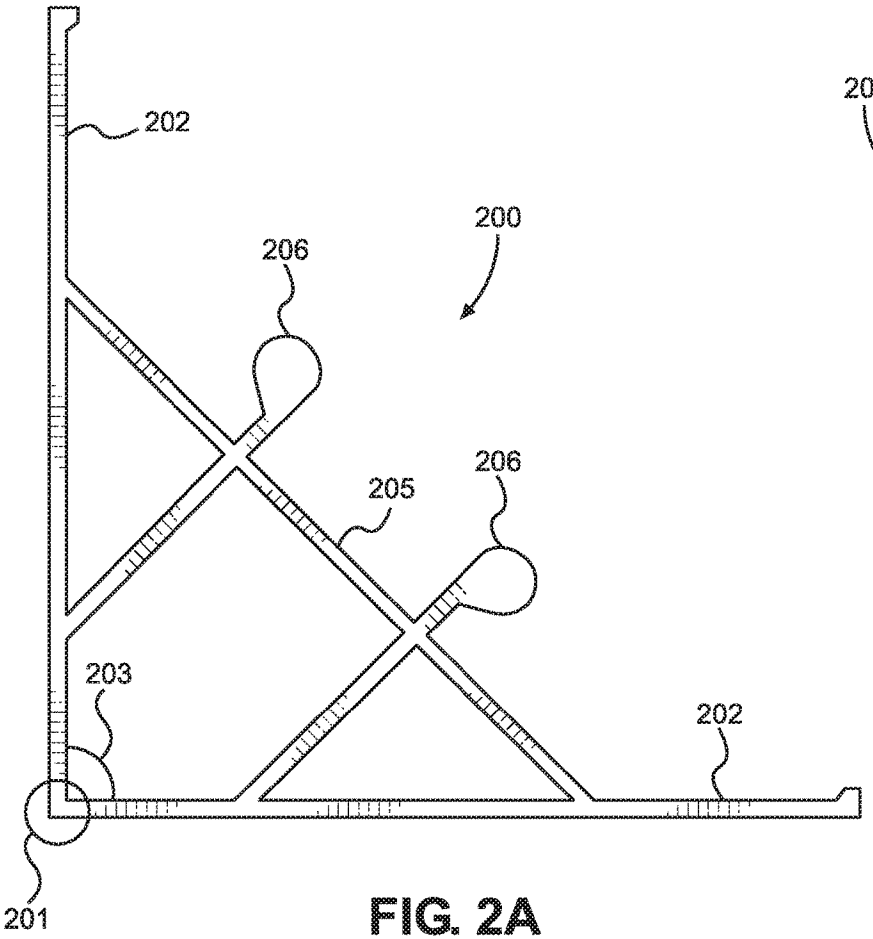
FIG. 2A shows a top down view of an embodiment of an inside corner device for the shoring device for corners.

Referring now to FIGS. 2A and 2B, there is shown two views of an embodiment of an inside corner device for the shoring device for corners. The shown device is an interior angle corner shoring device 200. The device has a pair of sidewalls 202 that meet at a point forming a vertex 201. The sidewalls 202 will extend out away from the vertex 201. The vertex 201 points away from the device. In one embodiment an interior angle 203 of the vertex 201 is a 90-degree angle. In other embodiments other angles may be formed.

In one embodiment the sidewalls 202 will be twelve inches long. In other embodiments the sidewalls 202 will be of other lengths. In one embodiment there are a plurality of apertures 204 along an exterior edge of the sidewalls 202. An exterior edge is an edge on the opposite side of the sidewall 202 from the vertex 201.

The interior angle corner shoring device 200 further includes a support wall 205. The support wall 205 is connected to the interior side of each of the sidewalls 202. The support wall 205 will prevent the sidewalls 202 from closing in upon themselves. A second function of the support wall 205 is to accept a portion of the hydraulic arm as shown in FIG. 1.

The support wall 205 and the sidewalls 202 further have a pair of support braces 206 connected thereto. The support braces 206 will hold a hydraulic arm in place. In one embodiment the support braces 206 have a plurality of apertures 207 that are located therethrough. The plurality of apertures 207 will allow for pins for the hydraulic arm to be placed therethrough holding the hydraulic arm in place. The support braces 206 will further help transfer pressure from the hydraulic arm through the support wall 205 to the vertex 201.

Figure 3B:
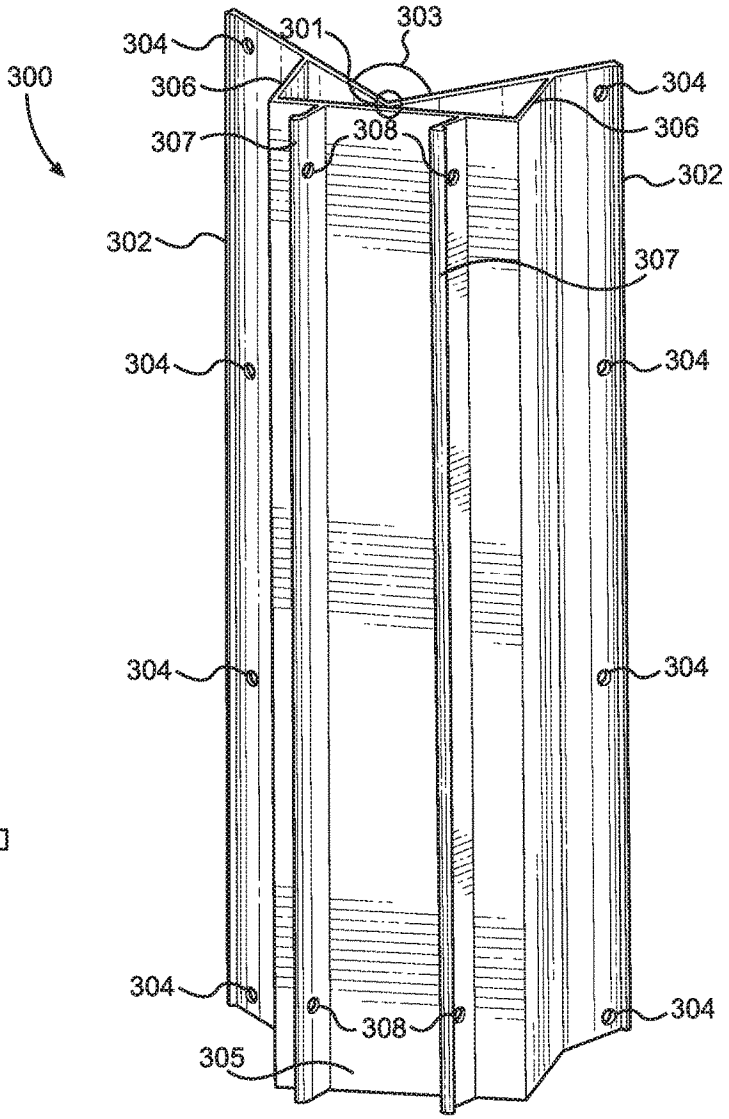
FIG. 3B shows a perspective view of an embodiment of an outside corner device for the shoring device for corners.
Figure 3A:
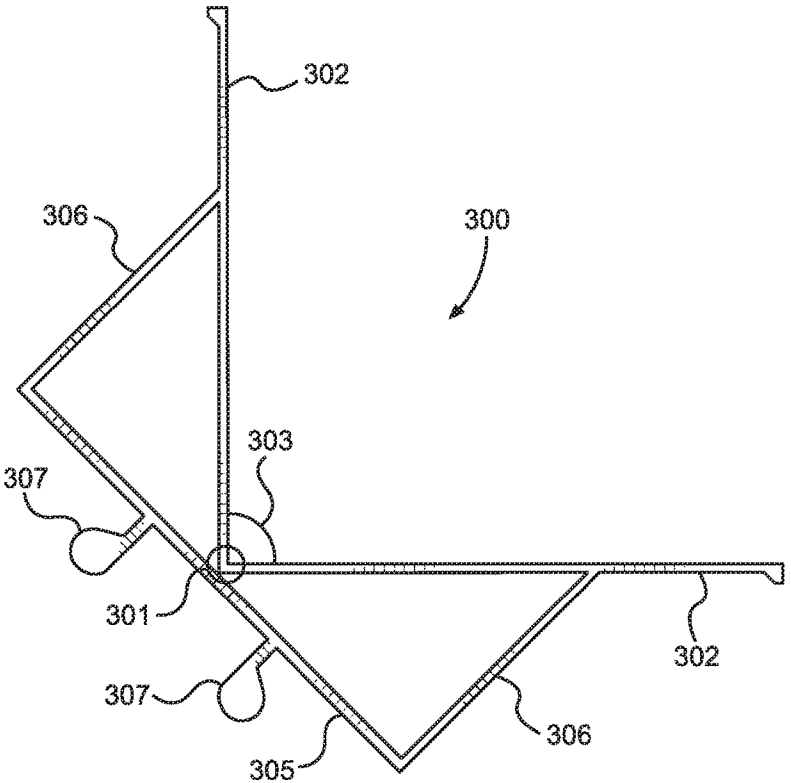
FIG. 3A shows a top down view of an embodiment of an outside corner device for the shoring device for corners.

Referring now to FIGS. 3A and 3B, there is shown two views of an embodiment of an outside corner device for the shoring device for corners. The shown device is an exterior angle corner shoring device 300. The device has a pair of sidewalls 302 that meet at a point forming a vertex 301. The sidewalls 302 will extend out away from the vertex 301. The vertex 301 points inward toward the device. In one embodiment an exterior angle 303 of the vertex 301 is a 90-degree angle. In other embodiments other angles may be formed.

In one embodiment the sidewalls 302 will be twelve inches long. In other embodiments the sidewalls 302 will be of other lengths. In one embodiment there are a plurality of apertures 304 along an exterior edge of the sidewalls 302. An exterior edge is an edge on the opposite side of the sidewall 302 from the vertex 301.

The exterior angle corner shoring device 300 further includes a support wall 305. The support wall 305 is connected to the exterior side of each of the sidewalls 302 via a pair of support connectors 306. The support connectors 306 will connect to the ends of the support wall 305 and connect to the sidewalls 302. The support wall 305 is further connected in the middle to the vertex 301. The support wall 305 will accept a portion of the hydraulic arm as shown in FIG. 1. This will allow pressure from the hydraulic arm to be applied to the vertex 301 and to the sidewalls 302.

The support wall 305 further includes a pair of support braces 307. The support braces 307 are configured to support the hydraulic arm. In one embodiment the support braces 307 have a plurality of apertures 308 therein. The plurality of apertures 308 will allow for pins for the hydraulic arm to be placed therethrough holding the hydraulic arm in place.

Figure 4B:
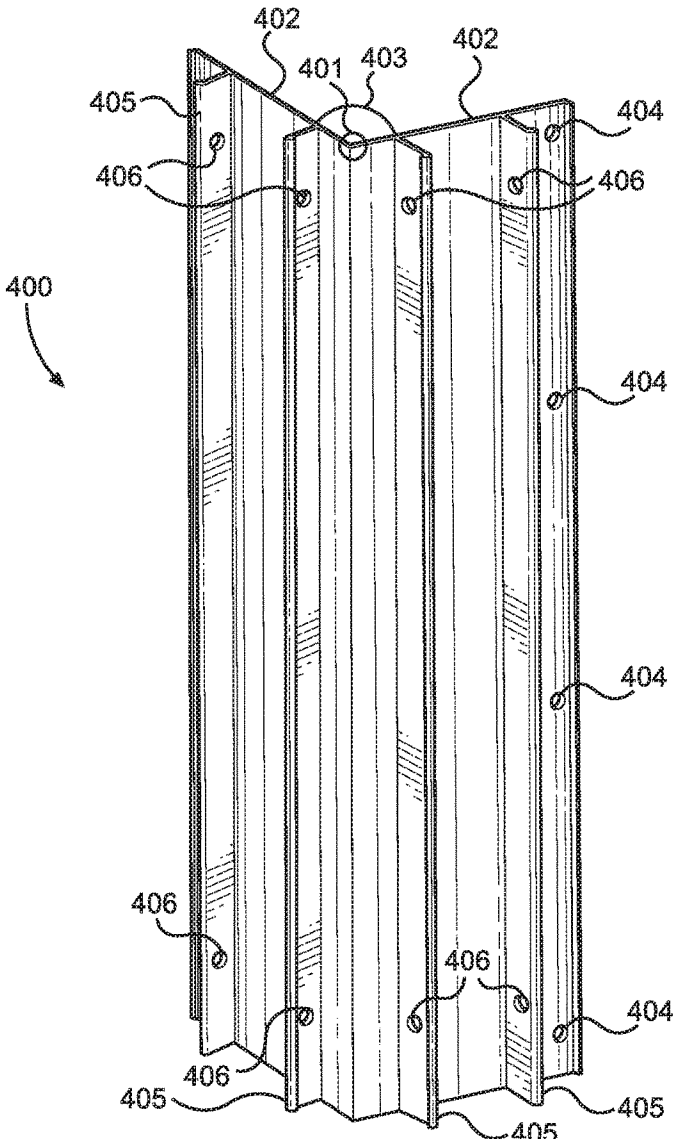
FIG. 4B shows a perspective view of an embodiment of a "T" corner device for the shoring device for corners.
Figure 4A:
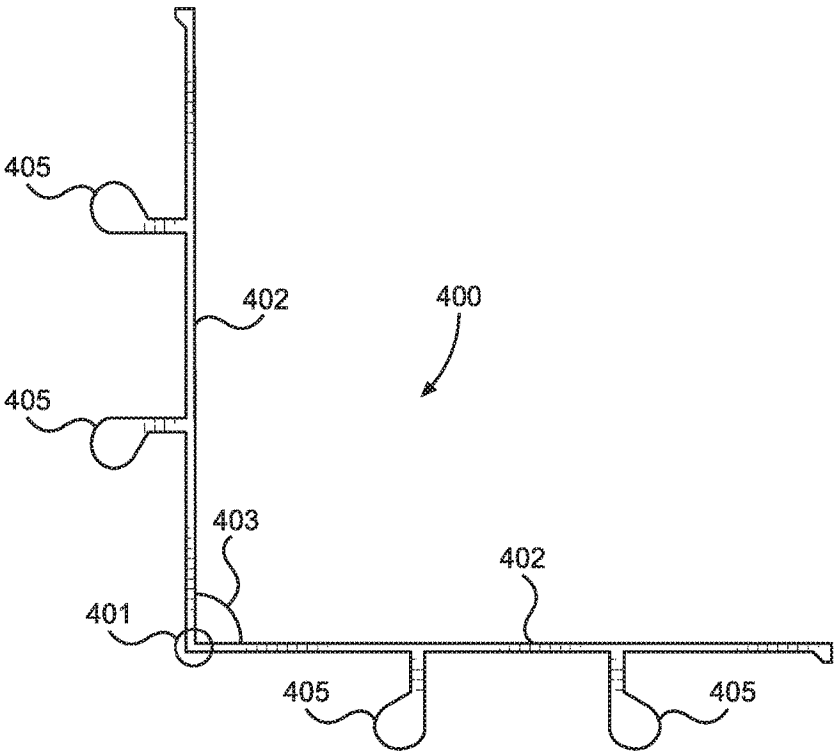
FIG. 4A shows a top down view of an embodiment of a "T" corner device for the shoring device for corners.

Referring now to FIGS. 4A and 4B, there is shown two views of an embodiment of a "T" corner device for the shoring device for corners. The shown device is an exterior angle corner shoring device for T corners 400. The device has a pair of sidewalls 402 that meet at a point forming a vertex 401. The sidewalls 402 will extend out away from the vertex 401. The vertex 401 points outward away from the corner of a ground wall. In one embodiment an interior angle 403 of the vertex 401 is a 90-degree angle. In other embodiments other angles may be formed.

In one embodiment the sidewalls 402 will be twelve inches long. In other embodiments the sidewalls 402 will be of other lengths. In one embodiment there are a plurality of apertures 404 along an exterior edge of the sidewalls 402. An exterior edge is an edge on the opposite side of the sidewall 402 from the vertex 401.

The exterior angle corner shoring device for T corners 400 further includes a pair of support braces 405 externing from each of the sidewalls 402. The support braces 405 will accept a portion of a hydraulic arm. This will allow pressure from the hydraulic arm to be applied to the sidewalls 402. In one embodiment the support braces 405 have a plurality of apertures 406 therein. The plurality of apertures 406 will allow for pins for the hydraulic arm to be placed therethrough holding the hydraulic arm in place.

Figure 4C:
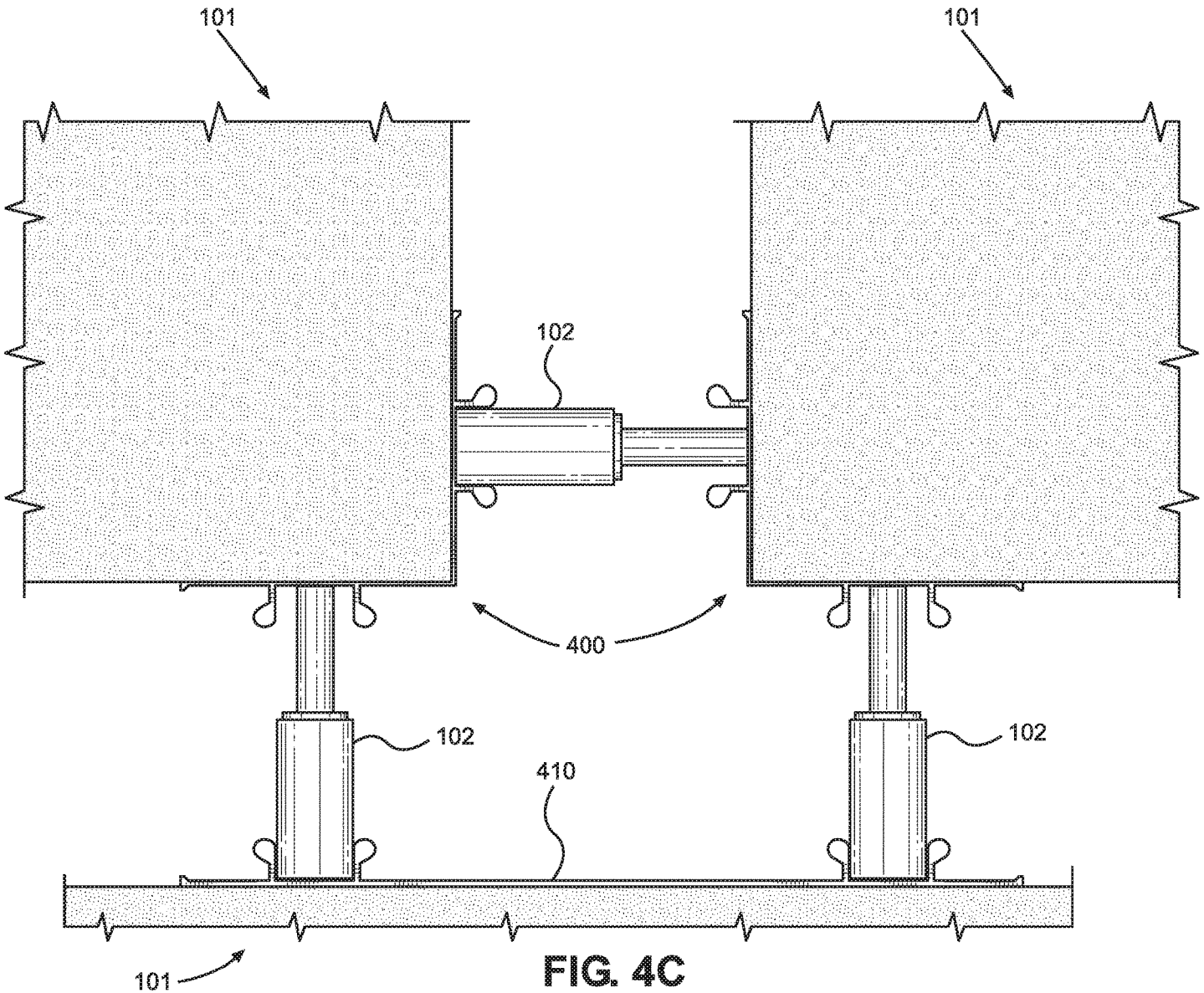
FIG. 4C shows a top down in-use view of an embodiment of a "T" corner device for the shoring device for corners.

Referring now to FIG. 4C, there is shown a top down in-use view of an embodiment of a "T" corner device for the shoring device for corners. The is shown two shoring devices for T corners 400. The devices 400 are pressed against a ground wall 101. A hydraulic arm 102 is located between the shoring devices for T corners 400. The hydraulic arm 102 will apply pressure holding the devices 400 firmly against the ground wall 101. A supporting plate 410 is used to hold additional hydraulic arms 102 in place. These hydraulic arms 102 will apply pressure to the corners and to the opposing ground wall 101. In this manner a T corner can be shored and made safe.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoring system for corners, comprising:

an interior angle shoring device;

the interior angle shoring device comprising a vertex that points outward into a corner to be shored;

a pair of interior angle shoring device sidewalls extending outward from the interior angle shoring device vertex;

wherein the interior angle shoring device comprises an interior support wall connected to the interior side of each of the pair of interior angle shoring device sidewalls;

wherein the pair of interior angle shoring device sidewalls and the interior support wall comprise an interior pair of support braces connected thereto;

an exterior angle corner shoring device;

the exterior angle corner shoring device comprising an inward pointing vertex;

a pair of exterior angle shoring device sidewalls extending away from the inward pointing vertex;

wherein the exterior angle shoring device comprises an external support wall connected to the exterior side of each of the pair of exterior angle shoring device sidewalls;

wherein the pair of exterior angle shoring device sidewalls and the external support wall comprise an exterior pair of support braces connected thereto;

a hydraulic arm disposed between the interior angle shoring device and the exterior angle shoring device;

the interior pair of support braces defining a first space to receive a first end of the hydraulic arm therebetween;

the exterior pair of support braces defining a second space to receive a second end of the hydraulic arm therebetween.

2. The shoring system for corners of claim 1, wherein an interior angle of the interior angle shoring device is a 90-degree angle.

3. The shoring system for corners of claim 1, wherein the interior angle shoring device comprises a plurality of apertures along an exterior edge of the pair of interior angle shoring device sidewalls.

4. The shoring system for corners of claim 1, wherein an exterior angle of the exterior angle shoring device is a 90-degree angle.

5. The shoring system for corners of claim 1, wherein the exterior angle shoring device comprises a plurality of apertures along an exterior edge of the pair of exterior angle shoring device sidewalls.

6. The shoring system for corners of claim 1, wherein the hydraulic arm applies pressure to the interior angle shoring device vertex and the inward pointing vertex of the exterior angle shoring device.

* * * * *